US010252175B2

(12) United States Patent
Moore et al.

(10) Patent No.: US 10,252,175 B2
(45) Date of Patent: Apr. 9, 2019

(54) ARTICLE MOVEABLE BETWEEN TWO POSITIONS AND A METHOD OF COMBINING TWO OR MORE OF THE SAME

(71) Applicant: BOTI GLOBAL LIMITED, Wan Chai (HK)

(72) Inventors: Steven Moore, London Greater London (GB); Brian Whitehead, London Greater London (GB); Tim Rowe, London Greater London (GB); Oliver Morris, London Greater London (GB)

(73) Assignee: BOTI GLOBAL LIMITED, Wan Chai (HK)

( * ) Notice: Subject to any disclaimer, the term of this patent is extended or adjusted under 35 U.S.C. 154(b) by 0 days.

(21) Appl. No.: 15/304,158

(22) PCT Filed: Apr. 15, 2015

(86) PCT No.: PCT/GB2015/051142
§ 371 (c)(1),
(2) Date: Oct. 14, 2016

(87) PCT Pub. No.: WO2015/159077
PCT Pub. Date: Oct. 22, 2015

(65) Prior Publication Data

US 2017/0036131 A1 Feb. 9, 2017

(30) Foreign Application Priority Data

Apr. 15, 2014 (GB) ..... 1406782.1

(51) Int. Cl.
*A63H 33/00* (2006.01)
*A63H 33/26* (2006.01)

(52) U.S. Cl.
CPC ..... *A63H 33/003* (2013.01); *A63H 33/26* (2013.01)

(58) Field of Classification Search
CPC ..... A63H 33/003; A63H 33/26
USPC ..... 446/129, 130, 131, 132, 133, 487, 71
See application file for complete search history.

(56) References Cited

U.S. PATENT DOCUMENTS 4,575,348 A * 3/1986 Wiggs ..... A63H 13/16 446/310
5,310,375 A * 5/1994 Kanauchi ..... A44B 15/005 446/71
5,310,378 A * 5/1994 Shannon ..... A63H 33/004 446/268
7,306,504 B2 * 12/2007 Saucier ..... A63H 3/003 446/268
7,458,874 B2 * 12/2008 Rung ..... A63H 13/00 446/330

(Continued)

FOREIGN PATENT DOCUMENTS

EP 1287868 3/2003
EP 1820548 8/2007

(Continued)

*Primary Examiner* — Alexander Niconovich
(74) *Attorney, Agent, or Firm* — Hoffmann & Baron, LLP

(57) ABSTRACT

There is provided an article, the article being moveable between a first position and a second position and biased to the second position. The article is retained in the first position until a predetermined condition is met, and wherein when said predetermined condition is met the article moves from the first position to the second position.

9 Claims, 6 Drawing Sheets

(56) References Cited

U.S. PATENT DOCUMENTS

| | | | | |
|---|---|---|---|---|
| 7,785,168 | B2 * | 8/2010 | Yamada | A63H 33/003 446/376 |
| 8,066,542 | B2 * | 11/2011 | Ejima | A63H 33/003 446/376 |
| 8,500,508 | B2 * | 8/2013 | Yamada | A63H 33/003 446/130 |
| 8,814,629 | B2 * | 8/2014 | Johnston | A63H 33/003 273/359 |
| 8,974,264 | B2 * | 3/2015 | McCafferty | A63H 17/008 124/10 |
| 9,308,461 | B2 * | 4/2016 | Yamada | A63H 33/003 |
| 2003/0176146 | A1 * | 9/2003 | Norman | A63H 3/18 446/310 |
| 2009/0053969 | A1 * | 2/2009 | Hui | A63H 13/00 446/130 |
| 2012/0032395 | A1 * | 2/2012 | Levine | A63F 3/00157 273/238 |

FOREIGN PATENT DOCUMENTS

| | | |
|---|---|---|
| EP | 2251069 | 11/2010 |
| KR | 101375110 | 3/2014 |
| WO | 2011132796 | 10/2011 |

* cited by examiner

ARTICLE MOVEABLE BETWEEN TWO POSITIONS AND A METHOD OF COMBINING TWO OR MORE OF THE SAME

This application is a U.S. National Phase application under 35 USC § 371 of PCT/GB2015/051142, filed Apr. 15, 2015, which claims priority from and the benefit of GB 1406782.1, filed Apr. 15, 2014. Applicant claims the benefits of 35 U.S.C. §§ 119 and 120 to the PCT and GB applications, and the entire disclosures of both applications are incorporated herein by reference in their entireties.

The invention to which this application relates is an article or articles moveable between a first and second position when a predetermined condition is met. The invention further relates to a method of bringing two of said articles together in a predefined manner.

Although the following description refers exclusively to the use of such articles as play toys and a method of playing with two or more of the same, the person skilled in the art will appreciate that the present invention could also be used for various other purposes not limited to games.

Collectable toys have been known for sometime. In particular, collectable "battling" toys are also known and have been provided in many different forms, for example, the range of battling collectables sold under the trade name Beyblade™ involve propelling two spinning collectable items into a battle arena, the collectable items subsequently making contact with one another as their spinning paths coincide. The winner is the one which remains spinning in the arena having either knocked the other off of its spinning axis or out of the arena entirely. Various techniques may be used by the user when introducing the collectable item to the arena, in order to provide their collectable item with an advantage against the opposing collectable item.

Another form of collectable battling toy, sold under the trade name Bakugan™ involves toys that can transform from a first condition into a second condition prior to or during battle. Determination of the winner can be decided by a set of specific playing cards which can indicate what moves may be played or health points etc. may be gained. Again, as the battle/game progresses, users/players will have an indication of who may emerge as the eventual winner. However, neither of these sets of "battling" collectables provides a scenario where the final winner will remain unknown until the eventual outcome is known, with little or no indication prior to the outcome.

It is therefore an aim of the present invention to provide an article that overcomes the aforementioned problems.

It is a further aim of the present invention to provide a combination of two or more articles that overcomes the aforementioned problems.

It is yet a further aim of the present invention to provide a method of combining two or more articles that overcomes the aforementioned problems.

According to a first aspect of the invention there is provided an article, said article being moveable between a first position and a second position and biased to the second position, said article being retained in the first position until a predetermined condition is met, wherein when said predetermined condition is met biasing means exert a biasing force to move the article from the first position to the second position.

In one embodiment the said predetermined condition is created by a second article which may in one embodiment, be similar to the first article, being brought into contact with, or being positioned within a predetermined range of, the said first article.

In one embodiment the contact or positioning of the respective articles has to be in a predetermined relationship in order to cause the predetermined condition to be achieved.

In one embodiment, the article is provided with retaining means. Typically, said retaining means retain the article in the first position. Further typically, said retaining means are provided in the form of a catch. Further typically, said catch is magnetically releasable.

In one embodiment, said second position is an inverted form of the article with respect to said first position. Typically, when said predetermined condition is met, the article moves from said first position to the second, inverted position.

In one embodiment, the article forms a polyhedron composed of four or more faces and/or panels. Typically, the article forms a tetrahedron, pentahedron, cube, octahedron, dodecahedron, or icosahedron shape and/or the like. Further typically, the faces and/or panels of the polyhedron are biased to the second position.

In one embodiment, the article is composed of six panels. Typically, said six panels connect to form faces of a substantially cube-shaped article. Further typically, said panels are biased to the second position.

In one embodiment, the article is provided with biasing means. Typically, said biasing means bias the article toward the second position. Further typically, said second position is an inverted form of the article with respect to said first position.

In one embodiment, said biasing means are provided in the form of one or more springs. Typically, said one or more springs are provided as any or any combination of coil springs, leaf springs, torsion springs, hair springs and/or the like.

In one embodiment, biasing means are provided at or substantially at an interface between two adjacent panels. Typically, said biasing means are connected to the two adjacent panels, biasing said panels to the second position.

In one embodiment, retaining means is provided on at least one panel. Typically, said retaining means connects the panel on which it is located to an adjacent panel, thereby retaining the article in the first position.

In one embodiment, the panels of the article are hinged. Typically, said retaining means retains adjacent free edges of two panels, thereby retaining the article in the first position. Further typically, the article is retained in the first position by the retaining means against the action of the biasing force.

In one embodiment, a first magnet is provided on, or associated with, the article. Typically, said first magnet is located on, or associated with, one of the said panels of the article. Further typically, said first magnet is located on, or associated with, a panel on which retaining means are also located.

In one embodiment, activation of said first magnet releases said retaining means, allowing the article to move from the first position to the second position. Typically, the article is moveable from the first position to the second position due to the biasing force of the biasing means.

In one embodiment, a second magnet is provided on, or associated with, the article. Typically, said second magnet is provided on, or associated with, the same panel as said first magnet. Further typically, said second magnet is provided to activate a corresponding magnet on a second article.

In one embodiment, first and/or second magnets are removably attached to said article. Typically, the first and/or second magnets are removably located with one of the said panels of the article. Further typically, the first and/or second magnets are removably located within an aperture within one of the said panels of the article.

In one embodiment, said first and/or second magnets are located on a body removably attachable to said article. Typically, said body is removably attached to one of the said panels of the article. Further typically, said body is removably located within an aperture in one of the said panels of the article. Yet further typically, said body may be removably located with a second or further article.

In one embodiment, said body is located with the article such that it is located within an interior of the article when the article is in the first position.

In one embodiment, said first magnet is locatable in one of a plurality of predetermined locations on one panel.

In one embodiment, said second magnet is locatable in one of a plurality of predetermined locations on one panel.

In a further aspect of the present invention there is provided a group of articles including at least two articles moveable between first and second positions, said articles retained in their respective first positions until a predetermined condition is met, wherein said predetermined condition is met for at least one of the articles when the articles are brought into contact or within a predefined distance, at which point said one of the at least two articles moves from the first position to the second position under the influence of biasing means.

In one embodiment, said second position is an inverted form of the at least two articles with respect to said first position. Typically, when said predetermined condition is met in one of the articles, the article moves from said first position to the second, inverted position.

In one embodiment, said second position, when the predetermined condition is met in a first of the at least two articles, is for the first article to move, typically inverting, and at least partially engulfing, enclosing and/or entrapping a second of said at least two articles.

In one embodiment, first and second magnets are located on or associated with, each of the at least two articles. Typically, the first magnet on or associated with, a first article corresponds to a second magnet on or associated with, a second article. Further typically, when the first magnet on or associated with, the first article contacts, or is within a predefined distance of the second magnet on or associated with, the second article, the predetermined condition is met for the first article. Thus, the first article is now moveable from the first position to the second position. Yet further typically, the movement of the first article from the first position to the second position involves the first article at least partially engulfing, enclosing and/or entrapping the second article.

In one embodiment, the first magnet on or associated with, the second article corresponds to a second magnet on or associated with, a third article. Typically, the second magnet on or associated with, the first article corresponds to a first magnet on or associated with, the third or a further article.

In one embodiment, first and/or second magnets are removably attached to each of said articles. Typically, the first and/or second magnets are removably located with one of the panels of each of the articles. Further typically, the first and/or second magnets are removably located within an aperture within one of the panels of each of the articles.

In one embodiment, said first and/or second magnets are located on a body removably attachable to each of said articles. Typically, said body is removably attached to one of the panels of each of the articles. Further typically, said body is removably located within an aperture in one of the panels of each of the articles. Yet further typically, a plurality of bodies are provided, which are removably attachable to each of said articles.

In one embodiment, retaining means are provided on each of the at least two articles. Typically, said retaining means retain the at least two articles in their respective first positions. Further typically, retaining means on a first of the at least two articles is released upon contact of the first magnet of the first article with the second magnet of the second article.

In one embodiment, biasing means are provided on each of the at least two articles. Typically, said biasing means bias the at least two articles to their respective second positions. Further typically, upon release of retaining means on a first of the at least two articles, said first article moves from the first position to the second position.

According to another aspect of the invention there is provided an article, said article being moveable between a first position and a second position, wherein the article moves from the first position to the second position when a predetermined condition is met.

In one embodiment, said article is biased to the second position and retained in the first position until the predetermined condition is met.

In a yet further aspect of the present invention there is provided a method of causing interaction between at least two articles, said method comprising the steps of: providing at least two articles in respective first positions and moveable between said first position and respective second positions; moving the at least two articles towards each other until a predetermined condition for either or both of the first and/or second articles is met and wherein once said predetermined condition is met in an article, that article moves from the first position to the second position; and as it does so, at least partially engulfing, enclosing and/or entrapping the other article.

In one embodiment, first and second magnets are located on, or associated with, each of the first and second articles, the first magnet on, or associated with, the first article corresponding to the second magnet on, or associated with, a second article, and wherein the first magnet on, or associated with, the first article is brought into contact with or within a predefined distance of the second magnet on, or associated with, the second article. Typically, the predetermined condition is met for the first article when the first magnet on, or associated with, the first article is brought into contact with or within a predefined distance of the second magnet on, or associated with, the second article. Thus, the first article is now moveable from the first position to the second position.

In one embodiment, the magnetic contact and/or interaction made by the first magnet on, or associated with, the first article and the second magnet on, or associated with, the second article releases a retaining means provided on the first article, which is provided to retain the article in the first position.

In one embodiment, and upon release of the retaining means, biasing means provided on the first article bias the same from the first position to the second position.

In one embodiment, a first user chooses the relative position of the first and second magnets on, or associated with, the first article. Typically, a second user chooses the relative position of the first and second magnets on, or associated with, the second article.

In one embodiment, the first and second magnets on, or associated with, each of the first and second articles are located on a single face and/or panel of the respective articles, and the said faces and/or panels of the first and second articles are moved towards each other. Typically, the said faces and/or panels are moved towards each other until the predetermined condition is met in either the first or second article.

In one embodiment, first and/or second magnets are removably attached to each of said articles by respective users. Typically, the first and/or second magnets are removably located with one of the panels of each of the articles. Further typically, the first and/or second magnets are removably located within an aperture within one of the panels of each of the articles.

In one embodiment, said first and/or second magnets are located on a body removably attachable to each of said articles by respective users. Typically, said body is removably attached to one of the said panels of the article. Further typically, said body is removably located within an aperture in one of the said panels of the article.

In one embodiment, said bodies are interchangeable between articles and a first user chooses a first body to be located with a first article and a second user chooses a second body to be located with a second article.

Each user selects a particular body for attachment to their respective article, and consequently, the properties of the magnets therein will determine which of the said articles is activated when two are brought into contact or within a predefined distance of one another.

In yet a further aspect of the present invention, there is provided a toy article for use in a game with other articles, wherein said article includes a plurality of hinged panels, biasing means to bias the panels, and hence the article, from a first position to a second position when a retaining catch is released to allow hinged movement of the respective panels, and a release means of a specific configuration.

In one embodiment, the catch means of the said article are activated to a release position under the influence of release means of a further of said articles when said release means of the further of said articles are in a particular configuration suited to release the said first article catch means.

In one embodiment, the release means are located on a body and a number of bodies with different release means configurations are available which can be selectively positioned on the article so as to allow the release means characteristics of the article to be selected.

In one embodiment, the article is configurable to provide a particular appearance and/or value to the article and which value is allocated to the article if that article is caused to move to the second position under the influence of the said further article.

In one embodiment, when an article moves to the second position under the influence of release means of a further article said further article will be positioned in proximity to the first article such that the movement to the second position by the first article causes the further article to be at least partially enclosed by the said first article while moving to the second position.

Embodiments of the present invention will now be described with reference to the accompanying figures, wherein:

FIGS. 1*a-d* illustrate the opening stages of an article in accordance with an embodiment of the present invention.

Figure 6A:
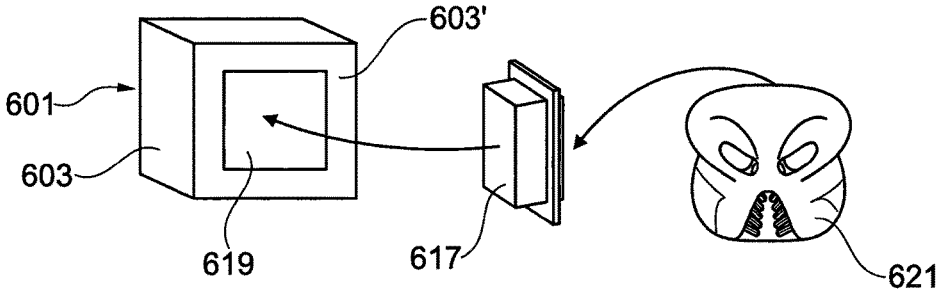
Figure 6B:
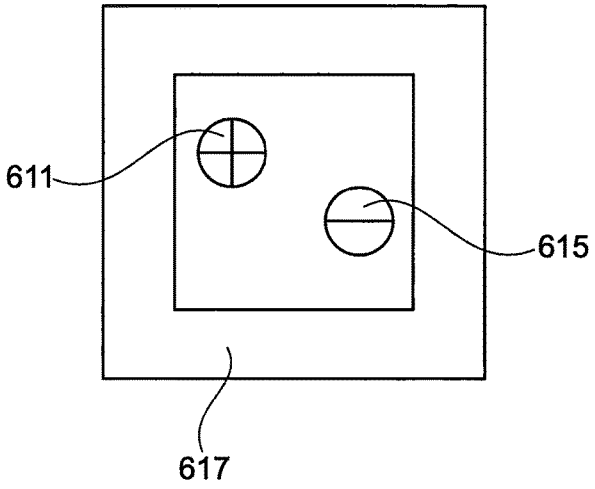
Figure 7A:
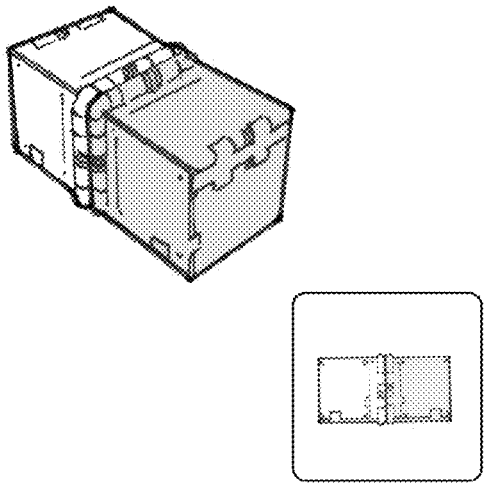
Figure 7B:
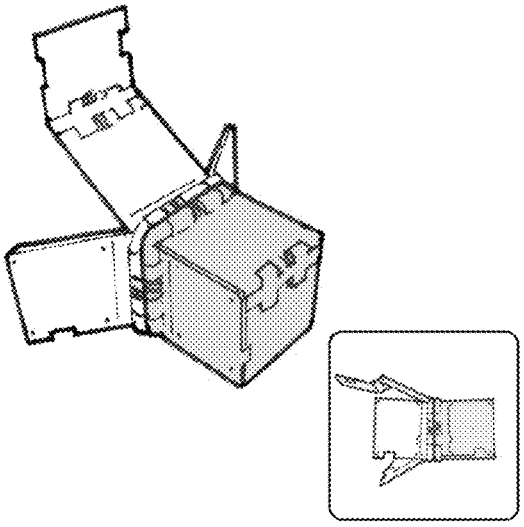
Figure 7C:
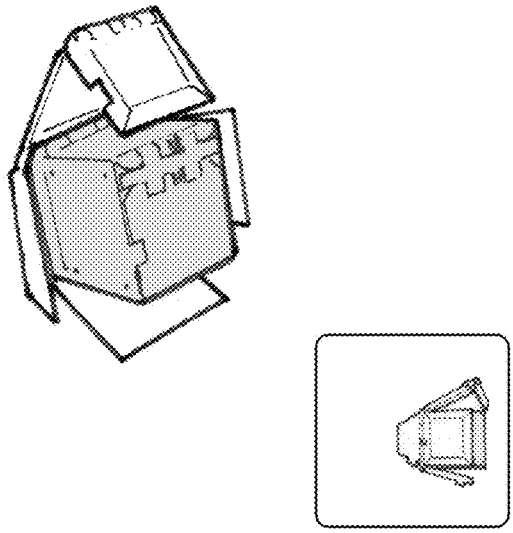
Figure 7D:
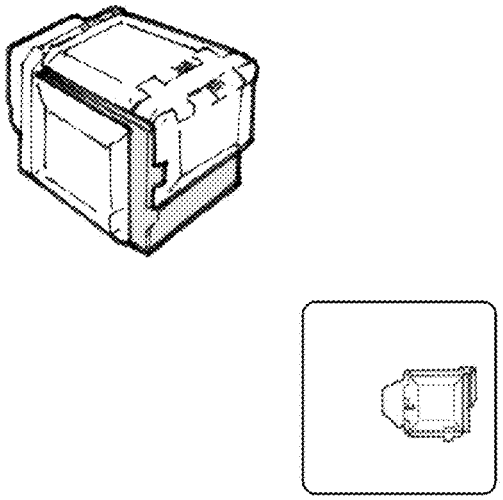

FIGS. 6*a-b* illustrate a separate body attachment for an article in accordance with an embodiment of the present invention.

FIGS. 7A-7D illustrate a pair of articles in accordance with an embodiment of the present invention interacting, and the movement of one article from a first position to a second position.

Figure 1:
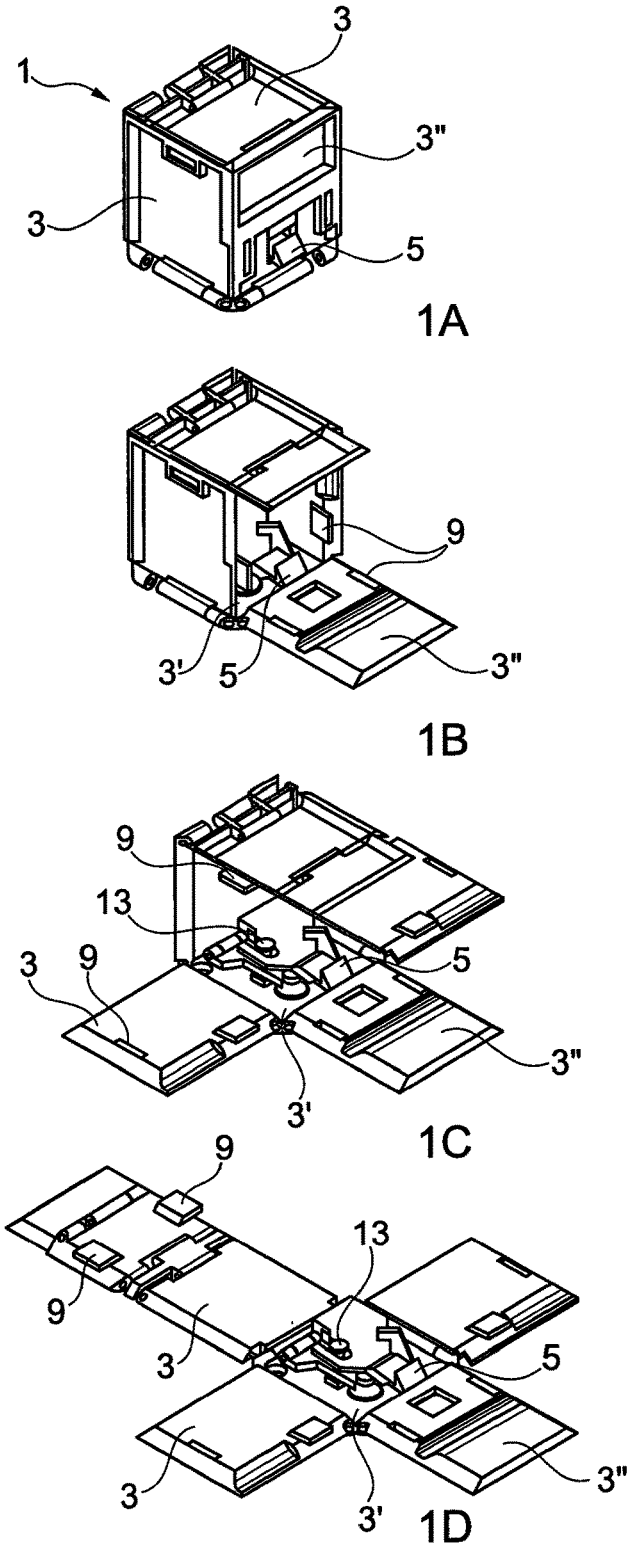
Figure 2:
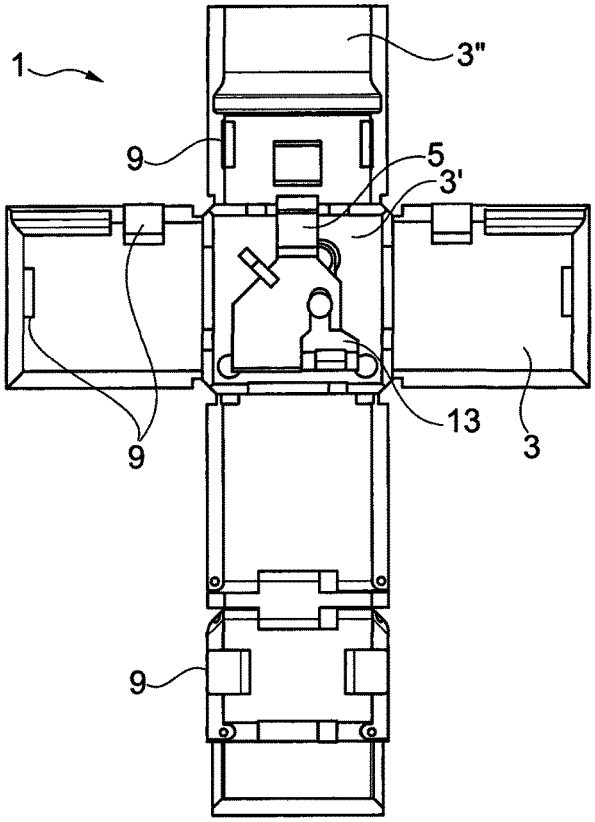
FIG. 2 illustrates a plan view of an opened-out article in accordance with an embodiment of the present invention.

Referring firstly to FIGS. 1*a-d*, there is provided an article in the form of a substantially cube-shaped playing collectable item or toy (1). The toy (1) can be moved from a first position, shown in FIG. 1*a*, and a second position, wherein the toy (1) is completely inverted with respect to its first position. FIGS. 1*a-d* illustrate the opening stages of the toy (1) from the first position in FIG. 1*a* to an intermediate position between the first and second positions in FIG. 1*d*, shown more clearly in FIG. 2. In this particular embodiment, the toy (1) is provided in a cube shape and is composed of six connected panels (3). The panels (3) are biased, via biasing means, to move to the second position but are retained in the first position until a predetermined condition is met. When the predetermined condition is met, the toy (1) moves from the first position to the second position. A release catch (5) is located on one of the panels (3') and, when the toy (1) is in the first position, the catch (5) engages an adjacent panel (3"), retaining it and the remaining panels (3) in the first position. The panels (3, 3', 3") of the toy (1) are hinged and the release catch (5) retains adjacent free edges of two panels (3', 3") in position, thereby retaining the toy (1) in the first position. The toy (1) is retained in the first position by the release catch (5) against the action of a biasing force until such point that it is released.

Figure 3:
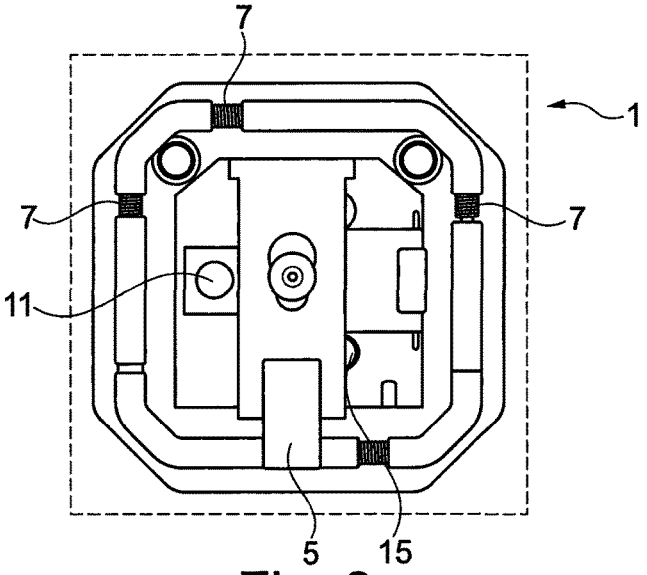
FIG. 3 illustrates a view of a magnet and retaining means on an article in accordance with an embodiment of the present invention.

Biasing means in the form of springs (7) are provided to bias the toy (1) to the second position. The springs (7) are best illustrated in FIG. 3. The springs (7) may be provided in various forms such as any or any combination of coil springs, leaf springs, torsion springs, hair springs and/or the like. In this particular embodiment, the springs (7) are provided as coiled torsion springs. The springs (7) are located at the edge of a panel (3), connecting the panel (3) on which it is located with an adjacent panel (3). The series of springs (7) that are provided on the panels (3) bias the toy (1) to the second, inverted position. This biasing movement is only allowed, however, upon release of the catch (5) from the adjacent panel (3") to which it connects. When the catch (5) is released from the adjacent panel (3"), that panel (3") opens outwardly due to the biasing force of the springs (7), shown in FIG. 1*b*. The remaining panels (3), which had previously been held in place in the first position by panel (3") and a series of secondary catches (9), subsequently open outwardly, as shown in FIGS. 1*c* and *d* until the toy (1) is in an inverted, second position.

Accordingly reference is now made to FIGS. 7A-7D that illustrate the sequence of actions in the movement by a first article that has moved next to a second article in accordance with the present invention, to invert and subsequently engulf, and trap and/or enclose the said second article. The activity of the first article in inverting itself and then surrounding the second article clearly depicts this aspect of the interaction of the toys in accordance with the invention.

The panel (3') on which the catch (5) is located is also provided with a first magnet (11), which is linked to a magnetic catch (13). This magnetic catch (13) is, in turn connected to the release catch (5) on the panel (3). Such connection provides for the release catch (5) to be magnetically releasable. The first magnet (11) may be provided as attached directly to the panel (3'), or in a preferred example, the magnet (11) is removably attachable to the panel (3'). When the first magnet (11) comes into contact or close proximity with a corresponding attracted magnet, or within a predefined distance of a corresponding attracted magnet, the magnet (11) releases the magnetic catch (13), which in turn allows the release catch (5) to cease from retaining adjacent panel (3") in the first position. Upon this release, the toy (1) moves from the first position to the second position under the force provided by the springs (7). A second, attractive magnet (15) is also provided on the same panel (3') as the first magnet (11) and the release catch (5) and will serve to act in the manner described above when brought into contact or close proximity with, or within a predefined distance of, an equivalent article or toy. As with the first magnet (11), the second magnet (15) may be provided as attached directly to the panel (3'), or in a preferred example, the second magnet (15) is also removably attachable to the panel (3'). The two magnets (11, 15) located on the panel (3') may also be located in a plurality of positions on the panel (3'). These positions may be predetermined by the manufacturer of the toy (1) or, in some embodiments, may be selected and changed by the user of the toy (1) itself. In a preferred embodiment, as exemplified in FIGS. 6*a-b*, the magnets (611, 615) are located on a separate body (617), which can be located on the toy (601). In particular, the body (617) can be located on the panel (603') or placed into a hole (619) formed in the panel (603'). The magnets (611, 615) can be located on or within the body (617), which, once inserted into the article (601), enable the toy (601) to behave as described above. The body (617) may be removed from the toy (601) just as easily as it is attached, and may also be substituted/interchanged with other similar bodies, which may include first and second magnets in a different configuration from those in the first body (617).

Additional attachments may also be provided for the article in order to allow a user to customise the same. For example, a face (621), as shown in FIG. 6*a* may be provided as attachable either to the toy (601) directly or to the body (617) that is subsequently attached to the toy (601). This enables a user to customise their particular toy and, further, special characteristics and/or points may be associated with each face in the scenario where multiple faces are provided.

Figure 4:
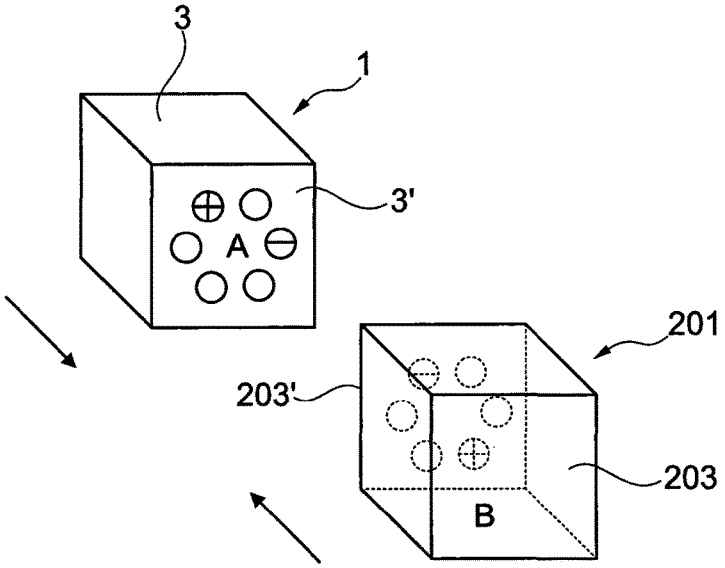
FIG. 4 illustrates a combination of a pair of articles in accordance with an embodiment of the present invention.

A second article or toy (201) with the same features as described above for the first toy (1, 601) may be provided. In this embodiment, the second toy (201) also has first and second magnets (211, 215) associated therewith, the second of which (215) is provided to act as an attractive magnet for the first magnet (11) on the first toy (1), in the manner described above. As with the first toy (1, 601), the magnets (211, 215) of the second toy (201) may also be removably attached directly or within a removably attachable body, as described above. Thus, as the first (1) and second (201) toys are moved together (represented by blocks A and B in FIG. 4) the attractive second magnet (215) on the second toy (201) activates the first magnet (11) on the first toy (1) when the two magnets contact each other or are brought within a predefined distance of one another. This enables the predetermined condition to be met in the first toy (1), wherein the magnet (11) releases the magnetic catch (13), which in turn allows the release catch (5) to cease from retaining adjacent panel (3") in the first position. The first toy (1) subsequently moves from the first position into the second, inverted position. In this instance, the second, inverted position involves the first toy (1) at least partially engulfing, enclosing and/or entrapping the second toy (201).

Figure 5:
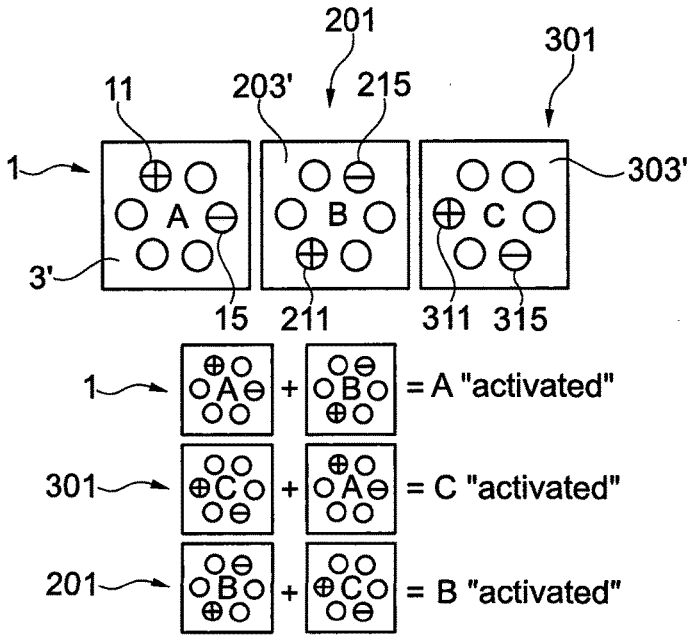
FIG. 5 illustrates various possible combinations of two or more articles in accordance with an embodiment of the present invention.

A third article or toy (301) may be introduced, which has the same features as the first and second toys (1, 201, 601) described above. In this instance, the second magnet (315) on the third toy (301) acts as an attractive magnet for the first magnet (211) on the second toy (201). Therefore, when the second and third toys (201, 301) are brought into contact or close proximity with, or moved within a predefined distance of each other, the predetermined condition for the second toy (201) is met and it subsequently moves from the first position to the second, inverted position at least partially engulfing, enclosing and/or entrapping the third toy (301). The first magnet (311) on the third toy (301) is therefore activated by the attractive second magnet (15) provided on the first toy (1). Therefore, when the first and third toys (1, 301) are brought into contact or close proximity with, or moved within a predefined distance of each other, the predetermined condition for the third toy (301) is met and it subsequently moves from the first position to the second, inverted position at least partially engulfing, enclosing and/or entrapping the first toy (1). This series of scenarios is depicted in FIG. 5, wherein each toy (1, 201, 301) is represented by blocks A, B and C. As will be appreciated, a "rock, paper, scissors" scenario is provided by the provision of the above toys (1, 201, 301, 601), although it will be appreciated that other such scenarios may also be provided for using arrangements such as this.

Each of the toys may be customised by their respective users who can choose not only which body (617) attaches to the toy, thereby defining the magnetic configuration of the toy and which other toys it will activate/be activated by, but also the user may choose which face is to be attached. This provides a means for additional scoring, rather than merely a "paper beats rock" etc. scenario; each face will have a certain number of points associated with it, positive or negative, and so a scoring system may be introduced for multiple users of the toys.

It will be appreciated that the above described toy (1) need not be restricted to a cube shape for the present invention to function as described. For example, such a mechanism may be provided for the movement of an article or toy from a first position to a second, substantially inverted position, wherein the article or toy is a pyramid, having either a three-(tetrahedron) or four-sided (pentahedron) base; octahedron; dodecahedron; icosahedron and/or the like.

The invention claimed is:

1. A group of articles including at least two articles moveable between first and second positions, each article including a plurality of hinged panels, and biased to their respective second positions, said articles retained in their respective first positions until a predetermined condition is met, wherein said predetermined condition is met for at least one of the articles when the articles are brought into contact or within a predefined distance, at which point said one of the at least two articles moves from the first position to the second position under the influence of biasing means, wherein the movement of one of said articles to the second position involves the panels of said article opening outwardly under the biasing force of the biasing means, causing the said article to engulf, enclose and/or entrap another of said articles.

2. A group of articles according to claim 1, wherein said second position is an inverted form of the first position.

3. A group of articles according to claim 1 wherein the said other article is that which caused the predetermined condition to be met.

4. A group of articles according to claim 1, wherein first and second magnets are located on, or associated with, at least two of the articles, and when a first magnet on, or associated with, a first article corresponds to a second magnet on, or associated with, a second article and contacts or is within a predefined distance of the second magnet on, or associated with, the second article, the predetermined condition is met for at least one of the said articles.

5. A group of articles according to claim 4, wherein the first magnet on, or associated with, the second article corresponds to a second magnet on, or associated with, a third article and wherein the second magnet on, or associated with, the first article corresponds to a first magnet on, or associated with, the third or a further article.

6. A group of articles according to claim 1, wherein first and/or second magnets are removably attached to each of said articles.

7. A group of articles according to claim 6, wherein said first and/or second magnets are located on a body removably attachable to each of said articles.

8. A group of articles according to claim 1, wherein retaining means are provided on each of the at least two articles to retain the at least two articles in their respective first positions.

9. A group of articles according to claim 1 wherein each of the articles in the group is a toy or model figure.

* * * * *